US008408313B2

(12) United States Patent
Yale et al.

(10) Patent No.: US 8,408,313 B2
(45) Date of Patent: Apr. 2, 2013

(54) METHODS FOR APPLICATION OF RESERVOIR CONDITIONING IN PETROLEUM RESERVOIRS

(75) Inventors: David P. Yale, Milford, NJ (US); Thomas J. Boone, Calgary (CA); Richard J. Smith, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 154 days.

(21) Appl. No.: 12/669,903

(22) PCT Filed: Aug. 26, 2008

(86) PCT No.: PCT/US2008/074342

§ 371 (c)(1), (2), (4) Date: Jan. 20, 2010

(87) PCT Pub. No.: WO2009/042333

PCT Pub. Date: Apr. 2, 2009

(65) Prior Publication Data

US 2010/0218954 A1 Sep. 2, 2010

Related U.S. Application Data

(60) Provisional application No. 60/995,761, filed on Sep. 28, 2007.

(51) Int. Cl.
*E21B 43/00* (2006.01)
*E21B 47/00* (2012.01)

(52) U.S. Cl. ..... 166/370; 166/250.02

(58) Field of Classification Search ..... 166/252.1, 166/257, 370, 250.02, 259, 272.2, 272.6
See application file for complete search history.

(56) References Cited

U.S. PATENT DOCUMENTS

| | | | | |
|---|---|---|---|---|
| 2,978,025 | A | | 4/1961 | Clark, Jr. |
| 3,358,759 | A | | 12/1967 | Parker |
| 3,616,855 | A | | 11/1971 | Colgate |
| 4,022,280 | A | | 5/1977 | Stoddard et al. |
| 4,023,193 | A | * | 5/1977 | Schroter et al. ..... 396/570 |
| 4,099,568 | A | | 7/1978 | Allen |
| 4,140,184 | A | | 2/1979 | Bechtold et al. |
| 4,158,638 | A | | 6/1979 | Tsai |
| 4,161,217 | A | | 7/1979 | Dilgren et al. |
| 4,265,310 | A | * | 5/1981 | Britton et al. ..... 166/259 |
| 4,406,499 | A | | 9/1983 | Yildirim |
| 4,407,367 | A | | 10/1983 | Kydd |

(Continued)

FOREIGN PATENT DOCUMENTS

WO WO 98/40605 9/1998

OTHER PUBLICATIONS

Dusseault, M. B., CHOPS: Cold Heavy Oil Production with Sand in the Canadian Heavy Oil Industry for Alberta Dept. of Energy, Mar. 2002, pp. 285-289, Chapter 13, www.energy.gov.ab.ca/OilSands/7789.asp.

(Continued)

*Primary Examiner* — Daniel P Stephenson
*Assistant Examiner* — Catherine Loikith
(74) *Attorney, Agent, or Firm* — ExxonMobil Upstream Research Company Law Department

(57) ABSTRACT

Methods and apparatuses for recovering heavy oil that, at least in one embodiment, include conditioning a reservoir of interest, then initially producing fluids and particulate solids such as sand to increase reservoir access. The initial production may generate high permeability channels or wormholes in the formation, which may be used for heavy oil production processes such as cold flow (CHOPS) or enhanced production processes such as SAGD, or VAPEX.

26 Claims, 7 Drawing Sheets

U.S. PATENT DOCUMENTS

| | | | | |
|---|---|---|---|---|
| 4,452,491 | A | 6/1984 | Seglin et al. | |
| 4,512,405 | A | 4/1985 | Sweatman et al. | |
| 4,706,751 | A | 11/1987 | Gondouin | |
| 5,823,631 | A | 10/1998 | Herbolzheimer et al. | |
| 5,860,475 | A | 1/1999 | Ejiogu et al. | |
| 5,899,274 | A | 5/1999 | Frauenfeld et al. | |
| 5,957,202 | A | 9/1999 | Huang | |
| 6,318,464 | B1 | 11/2001 | Mokrys | |
| 2002/0023752 | A1* | 2/2002 | Qu et al. | 166/308 |
| 2009/0236103 | A1 | 9/2009 | Yale et al. | |

OTHER PUBLICATIONS

Nasr, T.N. et al., "New Oil Production Technologies for Heavy Oil and Bitumens", 17th World Petroleum Congress, Sep. 1-5, 2002, pp. 249-251, Rio de Janeiro, Brazil.

Dusseault, M. B. et al., "CHOPS in Jilin Province, China", SPE International Thermal Operations and Heavy Oil Symposium and Int'l Horizontal Well Technology Conference, Nov. 4-7, 2002, pp. 1-7, Calgary, AB, Canada.

Dusseault, M. B. et al., "Sequencing Technologies to Maximize Recovery", 7th Canadian International Petroleum Conference, Jun. 13-15, 2006, pp. 1-16, Calgary, AB, Canada.

Sawatzky, R. et al., "Tracking Cold Production Footprints", Petroleum Society Canadian International Conference 2002, Jun. 11-13, 2002, pp. 1-16, Paper #2002-086, Calgary AB, Canada.

Tan, R. et al., "A New Methodology for Modelling of Sand Wormholes in Field Scale Thermal Simulations", Petroleum Society Canadian International Conference 2003, Jun. 10-12, 2003, pp. 1-10, Paper #2003-155, Calgary, AB, Canada.

* cited by examiner

METHODS FOR APPLICATION OF RESERVOIR CONDITIONING IN PETROLEUM RESERVOIRS

CROSS-REFERENCE TO RELATED APPLICATIONS

This application is the National Stage of International Application No. PCT/US2008/074342, filed Aug. 26, 2008, which claims the priority of U.S. Provisional application No. 60/995,761, and was filed on Sep. 28, 2007 which is hereby incorporated by reference.

FIELD OF THE INVENTION

Embodiments of the invention relate to in-situ recovery methods for heavy oils. More particularly, embodiments of the invention relate to methods for conditioning reservoirs to promote enhanced heavy oil recovery from sand and clay.

BACKGROUND OF THE INVENTION

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

DESCRIPTION OF THE RELATED ART

Bitumen is a highly viscous hydrocarbon found in porous subsurface geologic formations. Bitumen is often entrained in sand, clay, or other porous solids and is resistant to flow at subsurface temperatures and pressures. Current recovery methods inject heat or viscosity reducing solvents to reduce the viscosity of the oil and allow it to flow through the subsurface formations and to the surface through boreholes or wellbores. Other methods breakup the sand matrix in which the heavy oil is entrained by water injection to produce the formation sand with the oil; however, the recovery of bitumen using water injection techniques is limited to the area proximal the bore hole. These methods generally have low recovery ratios and are expensive to operate and maintain. However, there are hundreds of billions of barrels of these very heavy oils in the accessible subsurface in the province of Alberta alone and additional hundreds of billions of barrels in other heavy oil areas around the world. Efficiently and effectively recovering these resources for use in the market is one of the world's toughest and most significant energy challenges.

In-situ recovery of heavy oil or bitumen from porous subsurface geologic formations is made difficult by the very high viscosity (10,000 to 1,000,000 centipoise (cP)) of the oil. Current methods rely on either reduction of the viscosity of the oil via heating (steam injection) and/or injection of solvents or on increasing the effective permeability of the formation through production of some of the formation sand with the oil, often referred to as "cold heavy oil production with sand" or "CHOPS." The viscosity reduction methods rely on either heat, typically through steam injection, or the use of solvents or additives to recover the oil or bitumen and their recovery efficiency can be limited by the ability of the injected steam or solvent to contact a large percentage of the reservoir volume. CHOPS is generally applicable to only a narrow range of oil viscosities and gas-to-oil ratios ("GOR") in formations and generally has low recovery ratios (only about 1/10th of the oil in the formation is recovered).

A number of authors and patents (Dusseault, 2006; Jonasson et al, 2003; Coates et. al., 2002; Laureshen et al, 2001; Huang, 1999; Mokrys, 2001; Ejiogu et al, 1999; Frauenfeld et al, 1999) have suggested that high permeability channels ("wormholes") created in a reservoir during the CHOPS process could be used after the CHOPS process to gain increased access to the reservoir for various recovery processes that involve steam and/or solvent injection (e.g. SAGD, VAPEX, and variations). Wormholes may be created when weaker, higher porosity, or higher permeability portions of the reservoir are produced during the CHOPS process, leaving channels in the formation. The resulting formation has much higher porosity (e.g. less sand) or fully open channels. Subsequent injection of steam and/or solvents into the wormholes facilitates more effective contact of the steam and/or solvents with a larger portion of the reservoir. The benefit is comparable to drilling an uncased horizontal wellbore to access the reservoir. This increase in reservoir access allows improved recovery of hydrocarbons from the reservoir. However, the wormholes generated in these applications all depend on formations having a natural or inherent tendency to form wormholes. Such formations typically have less than about 10,000 cP fluids, highly uncemented sands, and significant initial gas contents (GOR).

In particular, Lillico & Jossy (1999), infra and Sawatzky et. al. (2001), infra suggest that in Athabasca, where the bitumen viscosity is too high to allow the CHOPS process to work, some steam or solvent injection can reduce the oil permeability to the point where the CHOPS process could proceed. As suggested in the papers and patents cited above, Sawatzky & Coates (2004), infra and Sawatzky et. al. (July 2003, October 2003), infra have suggested that in addition to thermal injection allowing the CHOPS process to proceed in high viscosity reservoirs, the increased reservoir access created by the wormholes can be used to get solvents and steam further into the reservoir than might otherwise be done with standard thermal and solvent injection processes.

In another approach, the method described in commonly assigned U.S. Pat. No. 5,823,631 (the '631 patent) utilizes separate bore holes for water injection and production. That method first relieves the overburden stress on the formation through water injection and then causes the hydrocarbon-bearing formation to flow from the injection bore hole to the production bore hole from which the heavy oil, water, and formation sand is produced to the surface. Although the method described in the '631 patent is a significant step-out improvement over conventional water injection techniques, there is still a need for further improved methods for continuously and cost-effectively recovering bitumen from subsurface formations.

Other background material may be found in: U.S. Pat. No. 5,823,631; U.S. Pat. No. 5,899,274; U.S. Pat. No. 5,860,475; U.S. Pat. No. 6,318,464; U.S. Pat. No. 5,957,202; Int'l Patent App. No. WO1998/40605; Int'l Patent App. No. WO2007/050180; Laurenshen, C. J., Menta, S. A., Miller, K. A., Moore, R. G., Ursenback, M. G., "Air injection recovery of cold-produced heavy oil reservoirs", Petrol. Soc. CIM/Can. Int. Petrol. Conf. (CIPC 2001) Proc. 2001. (Paper #2001-018) (2001); Coates, R. M., Lillico, D. A., London, M. J., Sawatzky, R. P., Tremblay, B. R., "Tracking cold production footprints", 53rd Annual Petrol. Soc. CIM Technical Meeting Proc. (Paper #2002-086) (2002); Dusseault, M. B., Lian, C. X., Ma, Y., Gu, W., Xu, B., "CHOPS in Jilin Province, China," SPE 79032 (2002); Jonasson, H, Slevinsky, R, Tan, T., "A new methodology for modeling of sand wormholes in field scale thermal simulations", 54th Annual Petrol. Soc. CIM Technical Meeting Proc. (Paper #2003-155) (2003); DUSSEAULT, M. B., "Sequencing technologies to maximize recovery", 57th Annual Petrol. Soc. CIM Technical Meeting Proc. (CIPC 2006) (Paper #2006-135) (2006); SAWATZKY, R., TREMBLEY, B., COATES, R., AERI/ARC Core Industry Research Program, 2000-2001 Evaluation Projects—Thermal Sand Production, aaci.arc.ab.ca/evaluation_projects_0001.htm (2001); SAWATZKY, R., TREMBLEY, B., COATES, R., AERI/ARC Core Industry Research Program, July 2003 Monthly Report, found at http://aaci.arc.ab.ca/reports/monthly_reports/2003/July2003.pdf (July 2003); SAWATZKY, R., TREMBLEY, B., COATES, R., AERI/ARC Core Industry Research Program, October 2003 Monthly Report, found at http://aaci.arc.ab.ca/reports/monthly_reports/2003/Oct2003.pdf (October 2003); LILLICO, D., JOSSEY, E., Thermal sand production: Initial evaluation of deep athabasca reservoirs, ADOE/ARC Core Industry Research Program, Report #9899-13 (1999).

SUMMARY OF THE INVENTION

In one embodiment of the present invention a method of increasing access to a subsurface formation is provided. The method includes accessing from at least one location, a subsurface formation having an overburden stress disposed thereon, the subsurface formation comprising heavy oil and one or more solids; conditioning the subsurface formation from the at least one location to increase fluid pressure in the subsurface formation; and initially producing from the at least one location at least a portion of the one or more solids and at least one fluid from the subsurface formation ("slurry production") to increase access to the subsurface formation utilizing the increased fluid pressure in the formation, producing from the at least one location at least a portion of the heavy oil from the formation ("hydrocarbon production") using the increased access. The methods may further include utilizing enhanced oil recovery techniques to produce additional heavy oil.

In another embodiment of the present invention a method of recovering heavy oil is provided. The method includes accessing from at least one location, a subsurface formation having an overburden stress disposed thereon, the subsurface formation comprising heavy oil and one or more solids; conditioning the subsurface formation using fluids to increase fluid pressure in the subsurface formation; and initially producing at least a portion of at least one of the heavy oil and fluids and one or more solids ("slurry production") utilizing the increased fluid pressure in the formation. The method may further include creating at least one high permeability channel extending from the at least one location into the subsurface formation and utilizing the at least one high permeability channel to produce additional heavy oil ("hydrocarbon production").

BRIEF DESCRIPTION OF THE DRAWINGS

The foregoing and other advantages of the present invention may become apparent upon reviewing the following detailed description and drawings of non-limiting examples of embodiments in which.

DETAILED DESCRIPTION OF THE INVENTION

Figure 1A:
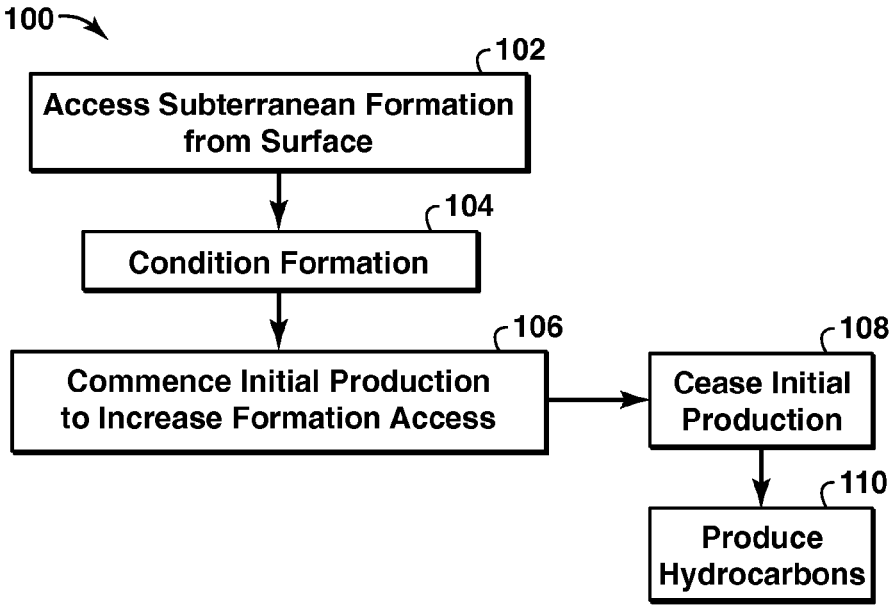
FIGS. 1A-1B are schematic illustrations of processes for producing heavy oil and sand from a subterranean formation.

In the following detailed description section, the specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

The term "heavy oil" refers to any hydrocarbon or various mixtures of hydrocarbons that occur naturally, including bitumen and tar. In one or more embodiments, a heavy oil has a viscosity of at least 500 centipoise (cP). In one or more embodiments, a heavy oil has a viscosity of about 1000 cP or more, 10,000 cP or more, 100,000 cP or more, or 1,000,000 cP or more.

The term "formation" refers to a body of rock or other subsurface solids that is sufficiently distinctive and continuous that it can be mapped. A "formation" can be a body of rock of predominantly one type or a combination of types. A formation can contain one or more hydrocarbon-bearing zones. Note that the terms "formation," "reservoir," and "interval" may be used interchangeably, but will generally be used to denote progressively smaller subsurface regions, zones or volumes. More specifically, a "formation" will generally be the largest subsurface region, a "reservoir" will generally be a region within the "formation" and will generally be a hydrocarbon-bearing zone (a formation, reservoir, or interval having oil, gas, heavy oil, and any combination thereof), and an "interval" will generally refer to a sub-region or portion of a "reservoir."

A hydrocarbon-bearing zone can be separated from other hydrocarbon-bearing zones by zones of lower permeability such as mudstones, shales, or shaley (highly compacted) sands. In one or more embodiments, a hydrocarbon-bearing zone includes heavy oil in addition to sand, clay, or other porous solids.

The term "overburden" refers to the sediments or earth materials overlying the formation containing one or more hydrocarbon-bearing zones. The term "overburden stress" refers to the load per unit area or stress overlying an area or point of interest in the subsurface from the weight of the overlying sediments and fluids. In one or more embodiments, the "overburden stress" is the load per unit area or stress overlying the hydrocarbon-bearing zone that is being conditioned and/or produced according to the embodiments described. In general, the magnitude of the overburden stress will primarily depend on two factors: 1) the composition of the overlying sediments and fluids, and 2) the depth of the subsurface area or formation.

The term "wellbore" and "borehole" are interchangeable and refer to a directly man-made void or hole that extends beneath the earth's surface, but is not a "wormhole." The hole can be both vertical and horizontal, and can be cased or uncased. In one or more embodiments, a wellbore can have at least one portion that is cased (i.e. lined) and at least one portion that is uncased.

The term "wormhole" refers to a high permeability channel in a formation generated as a result of a man-made process. More specifically, the process of removing heavy oil, particulate solids, and/or other materials from the formation through a wellbore creates a lower pressure zone around the wellbore. Additional materials flow into this low pressure zone leaving behind wormholes. Wormholes typically extend away from the low pressure region around the wellbore and may be open, roughly tubular routes or simply zones of higher porosity and high permeability than the surrounding naturally occurring formation.

The present invention relates to processes for recovering heavy oil from subsurface formations having at least one hydrocarbon reservoir and an overburden stress. More specifically, the present invention relates to a process of conditioning a reservoir of interest, then producing heavy oil and particulate solids (e.g. sand) by a cold flow process to generate high permeability channels in the formation. The process may further include enhanced recovery processes, such as injecting steam, solvents, or other treating agents into the high permeability channels to produce additional heavy oil and other hydrocarbons.

In one embodiment, the conditioning process comprises increasing the reservoir pressure sufficiently to change certain rock and reservoir properties of one or more intervals in the reservoir, including decreasing the overburden stress. This pressurization may be accomplished by injecting a fluid into the one or more intervals. The fluid may be a liquid, gas, or a combination. A wide range of fluids could be used as injectants to condition the reservoir. Examples of such fluids include, but are not limited to water, brine, oil, solvents, steam, natural gas (e.g. ethane, methane, or propane) or viscous oils or emulsions.

In one preferred embodiment, raising the reservoir pressure causes differential stresses (horizontal effective stress minus vertical effective stress) in the reservoir to increase at the same time mean effective stress (average total stress minus fluid pressure) is decreasing. Horizontal effective stress ($\sigma'_h$) on any given volume of reservoir rock may be defined as:

$$\sigma'_h=\sigma_h-p_f \quad \text{Eq. 1}$$

Where "$\sigma_h$" is the total stress acting on the reservoir in the horizontal direction and "$p_f$" is the fluid pressure in the reservoir. Similarly, the vertical effective stress ($\sigma'_v$) on the reservoir may be defined as:

$$\sigma'_v=\sigma_v-p_f \quad \text{Eq. 2}$$

and the differential stress (q) may be defined as:

$$q=\sigma'_h-\sigma'_v \quad \text{Eq. 3}$$

The mean effective stress ($\sigma'_m$ or p') in the reservoir may then be defined as:

$$p'=(2\sigma'_h+\sigma'_v)/3 \quad \text{Eq. 4}$$

Although the total vertical stress ($\sigma_v$) remains essentially constant during fluid injection into the reservoir, the total horizontal stress ($\sigma_h$) increases (so long as the reservoir rock is elastic or near elastic) during fluid injection due to the presence of rock on all horizontal sides of the reservoir rock volume. As such, for a given increase in fluid pressure ($p_f$), horizontal effective stress ($\sigma'_h$) decreases more slowly than vertical effective stress ($\sigma'_v$). Therefore, differential stress (q) increases and mean effective stress (p') decreases as fluid pressure ($p_f$) increases. Eventually, the differential stress (q) exceeds the strength of the reservoir rock and the rock mechanically fails allowing the total horizontal stress ($\sigma_h$) to fall during further increases in fluid pressure ($p_f$) in the reservoir.

Depending on how high reservoir pressure is raised, at least a portion of the reservoir interval may be brought beyond the point of mechanical failure. This change in reservoir stresses leads to changes in the rock properties of the reservoir interval. These changes may include, for example, increases in porosity (dilation), increases in permeability, decreases in the elastic moduli, the onset of plastic deformation in the interval (mechanical failure), and increases in the reservoir drive energy available to produce hydrocarbons (and/or other fluids and sand) from the reservoir. The increase in "drive energy" is attributable to the increase in fluid pressure in the reservoir and the increase in the compressibility of the rock due to conditioning.

In one preferred embodiment, the reservoir conditioning process may proceed to the point of just raising the reservoir pressure enough to allow certain portions of the reservoir to have a significantly lower overburden stress (referred to as "slight conditioning"). At least one other embodiment comprises conditioning the reservoir to a level between fully conditioned ("fully conditioned" refers to the point at which large portions of the reservoir become mobile when a pressure gradient is applied) and slightly conditioned (referred to as "partial conditioning"). The near wellbore area may also be "mostly conditioned," which is short of "fully conditioned," but past the point of mechanical failure of the reservoir. Although the conditioning process may be effective over a wide range, it is preferred that the reservoir is not fully conditioned causing the reservoir to become largely mobile because a fully conditioned reservoir likely would not result in the generation of discrete wormholes.

Beneficially, the present disclosure teaches new and non-obvious processes for generating wormholes and other increased access to formations that were previously thought to be unsuitable for wormhole formation. For example, CHOPS and other prior art approaches are generally only capable of generating increased access (e.g. wormholes) in formations having less than about 10,000 cP fluids, mostly uncemented sands, and high initial gas content (GOR) (e.g. over about 1,000 standard cubic feet of gas per barrel of oil (scft/bbl)). The present disclosure includes methods for generating increased access (e.g. wormholes) in a much wider variety of formations, such as, for example, formations having high viscosity hydrocarbon fluids (e.g. from about 10,000 cP to over about 1,000,000 cP or from about 20,000 cP to more than about 100,000 cP), cemented sands, other consolidated layers (e.g. shale, mudstone, etc.), and heterogeneities, and low initial gas content (e.g. less than about 1,000 scft/bbl or less than about 100 scft/bbl).

Figure 1B:
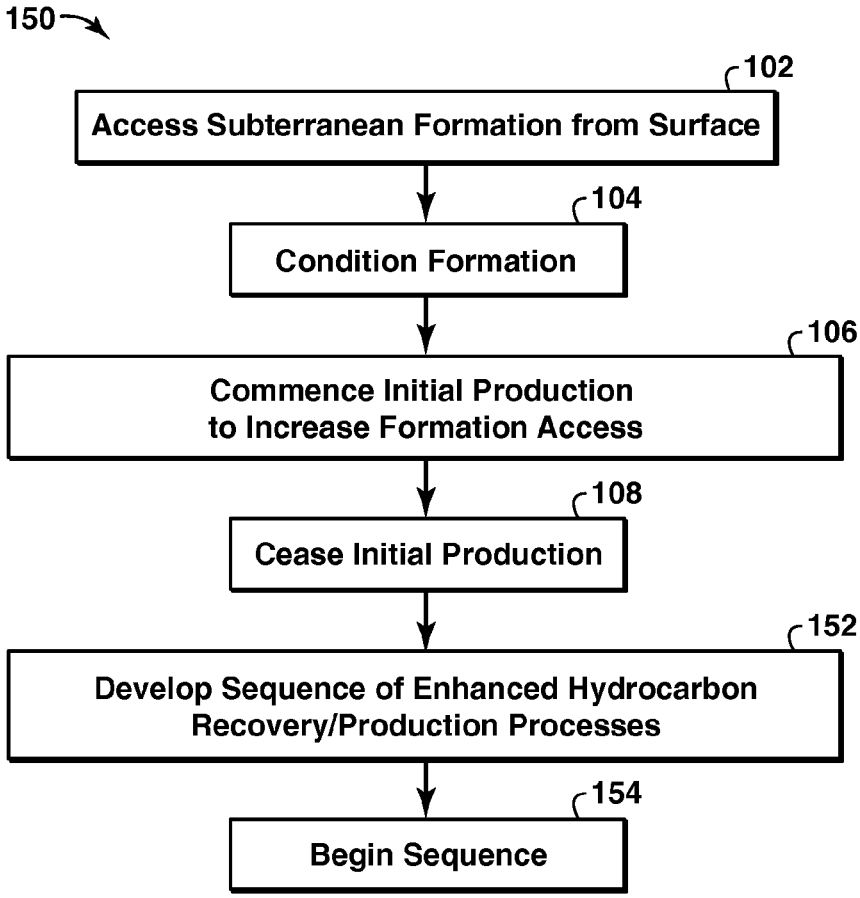

Referring now to the figures, FIGS. 1A-1B are illustrations of charts of multiple embodiments of the process of the present invention. In FIG. 1A, the process 100 begins by accessing a subterranean formation 102 from the surface, followed by conditioning the formation 104 sufficiently to permit initial production (e.g. slurry production) 106 to increase access to the formation, then ceasing 108 initial production, and beginning hydrocarbon production 110. In FIG. 1B, the process 150 begins with accessing a subterranean formation 102, conditioning 104, initial production 106, and ceasing initial production 108. Then, a sequence of at least two hydrocarbon recovery processes is developed 152 and the sequence is started 154.

In some embodiments of the process, the increased access is accomplished by generating high permeability channels (e.g. wormholes) in the formation. Initial production 106 will primarily produce conditioning fluids and particulate solids (e.g. sand), but may also produce other fluids such as formation water and some heavy oil. Then, hydrocarbon production 110 may commence, including enhanced oil recovery. The sequence of recovery processes 152 may be based on the formation of wormholes during initial production 106 and other factors and may include a single process, or may include ten or more processes in a sequence as well as intermediate steps. The recovery processes may include "standard" recovery processes such as cold production or enhanced oil recovery processes such as SAVEX, VAPEX, SAGD, and others.

Figure 2:
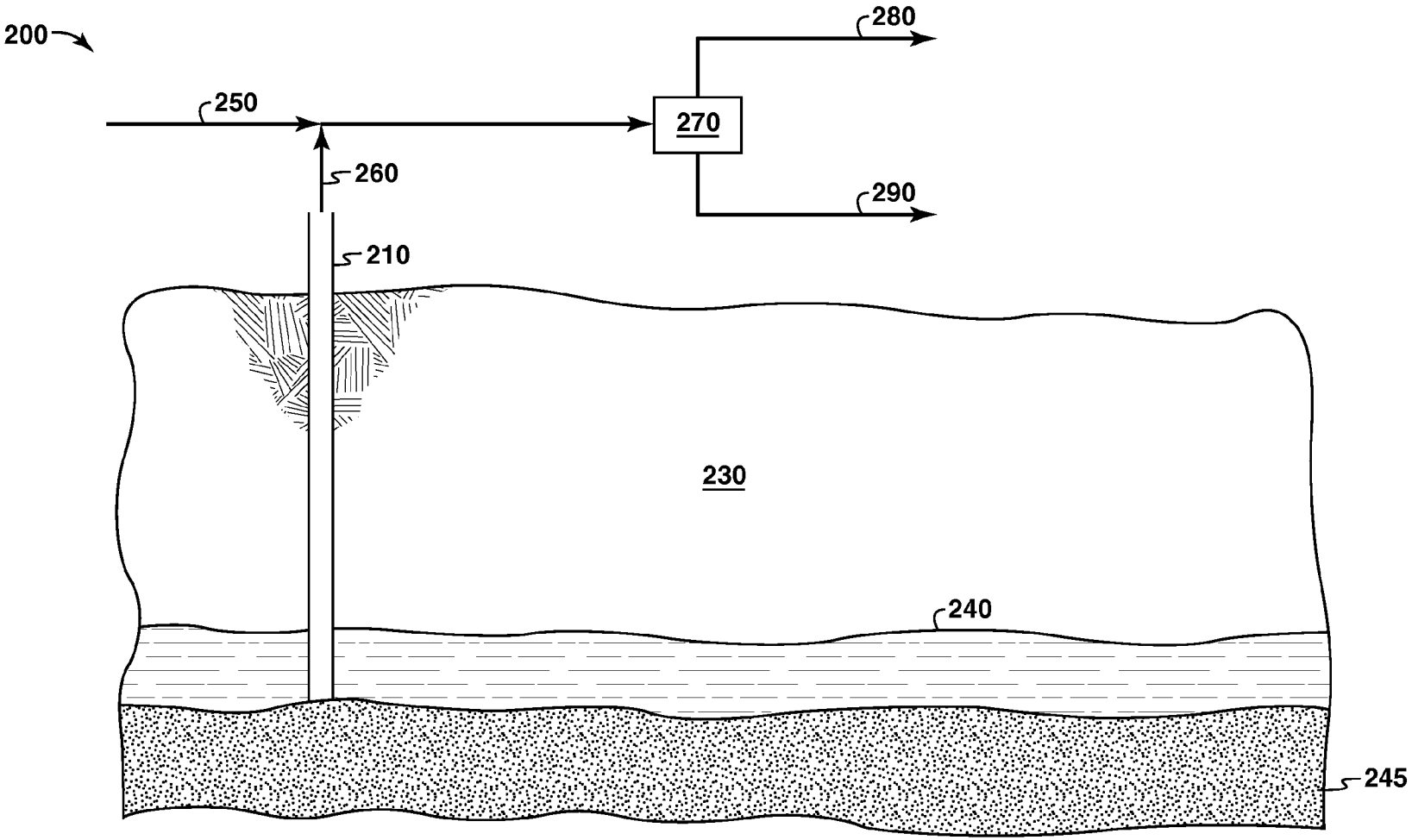
FIG. 2 is an illustration of an exemplary embodiment of a wellbore system for producing heavy oil from a subsurface formation utilizing the process of FIG. 1.

FIG. 2 is an illustration of an exemplary embodiment of a wellbore system 200 for producing heavy oil from a subsurface formation utilizing the processes of FIGS. 1A-1B. Hence, the wellbore system 200 of FIG. 2 may be best understood with reference to FIGS. 1A-1B. The wellbore system 200 may include one or more wellbores 210 (only one shown). The wellbore 210 extends from the surface through the overburden 230 and accesses a formation 240 that includes at least one hydrocarbon-bearing zone 245 (only one shown) from which conditioning fluids, particulate solids (e.g. sand), and other fluids (e.g. formation water and heavy oil) are to be initially produced 106. Then, the heavy oil and other hydrocarbons may be recovered 110 or 154. Note that in the process 100, each step 102-110 is preferably carried out at each wellbore 210, even if there are multiple wellbores.

Still referring to FIG. 2, an injection fluid (e.g. aqueous, non-aqueous, gas) is introduced to the hydrocarbon-bearing zone 245 through the wellbore 210 via stream 250. This injection process is an exemplary method of conditioning the formation 104. Once the formation is conditioned 104, conditioning fluids and particulate solids (e.g. sand) may be initially produced 106 from the same wellbore 210 to increase formation access, such as by generating high permeability channels (e.g. wormholes) by removal of some of the sand from the formation 240. Although preferably primarily made up of particulate solids and injected fluids, the initial production slurry can include any combination (e.g. mixture) of fluids and particulates including: injected fluids, clay, sand, water, brine, and hydrocarbons such as gas and heavy oil. The initial production slurry can be transferred via stream 260 to a recovery unit 270 where the heavy oil (and possibly other hydrocarbons such as gas) is separated and recovered from the solids and water. The recovery unit 270 can utilize any effective process for separating the heavy oil from the solids and water. Some exemplary processes include, but are not limited to cold water, hot water, and naphtha treatment processes combined with physical gravity separation processes. The present invention is not limited by the type of separation process used.

Referring again to FIG. 2, once initial production ceases 108, hydrocarbon production 110 may commence, or a sequence of production techniques is developed 152 and enhanced hydrocarbon production 154 may commence via wellbore 210. Enhanced hydrocarbon production 154 may comprise a wide variety of processes both known in the art and unknown, but will preferably utilize the wormholes generated by the initial production 106 of fluids and particulate solids. Some exemplary processes include, but are not limited to steam flood and steam drive, cyclic steam stimulation ("CSS"), water injection, inert gas injection, steam assisted gravity drainage ("SAGD"), vapor extraction ("VAPEX"), and gravity stabilized combustion. When recovered, the heavy oil (with possibly some residual hydrocarbons, solids, and water) may be passed via stream 280 for further separation and refining using methods and techniques known in the art. The hydrocarbon-free or nearly hydrocarbon-free solids and recovered water from the recovery unit 270 can be disposed via line 290 by recycling to the wellbore 210, sent to a disposal or storage site (not shown) or injected into another wellbore (not shown). Depending on process requirements, additional water or solids can be added to the disposal stream 290 or water or solids can be removed from the disposal stream 290 to adjust the solids concentration of the stream 290.

Conditioning Phase

Figure 3:
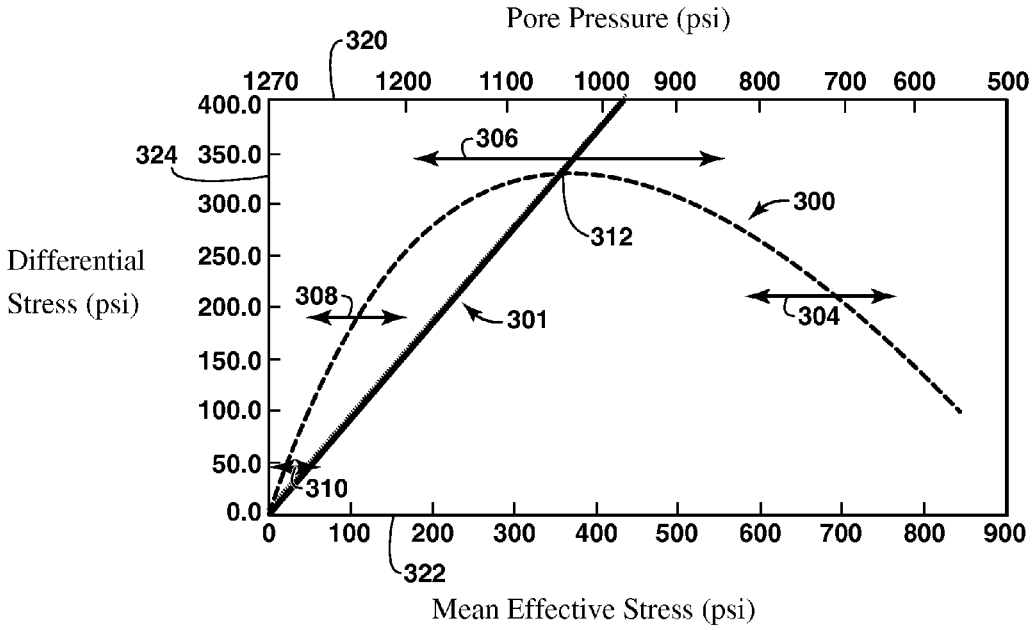
FIG. 3 is an illustration of an exemplary graph relating stress responses of a subterranean formation to a conditioning process as shown in FIG. 1.

The conditioning phase 104 is carried out through the exemplary wellbore system of FIG. 2 with exemplary stress effects on the formation 240 as shown in FIG. 3. Hence, the conditioning phase may be best understood with reference to FIGS. 1A-1B, 2, and 3. In one exemplary embodiment of the present invention, injection fluid may be pumped or otherwise conveyed through the wellbore 210 via stream 250 into the hydrocarbon-bearing zone 245 of the formation 240. One purpose of the injection fluid is to raise the fluid pressure in the formation 240 and relieve at least a portion of the overburden stress on the formation 240 (i.e. to "partially condition" or "slightly condition" the formation). Accordingly, the pressure of the injection fluid should be sufficient to at least slightly relieve the overburden stress. Another purpose of the injection fluid is to increase the initial porosity of the formation 240 and therefore, increase the permeability of the formation 240 to the injected fluid (generally water or brine) as well as to slightly or partially break up or disaggregate (through shear dilation) a portion of the shale or mudstone layers (not shown) that may be embedded within the hydrocarbon-bearing zones 245 of the formation 240. Further, this conditioning process affects differential stresses and increases the pore pressure (sometimes called "drive energy" or "fluid energy") in the formation 240.

FIG. 3 is a graphic illustration of an exemplary response curve showing the effect of one embodiment of the conditioning processes of FIGS. 1A-1B using an embodiment of the wellbore system of FIG. 2 on differential stress, mean effective stress, and pore pressure. As such, FIG. 3 may be best understood with reference to FIGS. 1A-1B and 2. FIG. 3 shows a graph displaying a curve 300 relating the pore pressure 320 (measured in pounds per square inch (psi)), mean effective stress 322 (measured in psi), and differential stress 324 (in psi) response as a formation is conditioned at approximately 450 meters (m). Also displayed is a critical state line slope (a property of the sand in the formation) 301 showing the relationship between differential and mean pressure at which the formation fails. The curve 300 begins at initial reservoir conditions 302 of about 825 pounds per square inch (psi) mean stress (overburden stress minus pore pressure), about 100 psi differential stress, and about 500 psi pore pressure. As the formation becomes slightly conditioned 304, then partially conditioned 306, the mean stress decreases as the pore pressure increases, and the differential stress increases until the point of mechanical failure 312 of the formation. At this point, the differential stress decreases and the mean stress decreases, while pore pressure increases through the mostly conditioned 308 and fully conditioned 310 stages. Both the differential and mean stresses go to zero when the formation is fully conditioned 310 while the pore pressure elevates. The increase in pore pressure imparts "drive energy" or "fluid energy" to the reservoir. As noted, the graph of FIG. 3 is merely exemplary. The process may be carried out in a formation having an initial pore pressure from at least about 100 psi to at least about 1,000 psi an initial overburden stress from at least about 200 psi to at least about 2,000 psi. However, the relationship between the pore pressure, mean effective stress, and the differential stress will be about the same in most formations suitable for the processes of the present invention.

In one exemplary embodiment, the pressure of the injection fluid should also be sufficient to permeate through the hydrocarbon-bearing zone 245 and develop a relatively constant pressure within the hydrocarbon-bearing zone 245 of the formation 240 at the end of conditioning. Preferably, the pressure of the injection fluid is at or above the stress of the overburden 230 exerted on the hydrocarbon-bearing zone 245 to allow the formation of horizontal or sub-horizontal fractures in the hydrocarbon-bearing zone. The preferred state is to slightly 304 or partially condition 306 the formation 240 sufficiently to increase access to the formation during initial production 106. Because of the natural heterogeneity in reservoirs, partial conditioning 306 allows portions of the formation 240 to be in a stress state where they are likely to allow sand to flow and portions where sand will not flow. This makes formation access and wormhole formation at least partially dependent upon the reservoir properties, but increased conditioning (up to a point) will almost always improve access and generate more wormholes.

If the stress of the overburden 230 is fully relieved or nearly fully relieved throughout a majority of the volume of the hydrocarbon-bearing zone from which heavy oil production is planned, the hydrocarbon-bearing zone 245 is considered to be "fully conditioned" 310. The fully conditioned state 310 may be desirable for other recovery processes, such as those disclosed in Int'l Pat. App. No. WO2007/050180 (the '180 application). The '180 application discloses a method comprising displacing or pulling the formation into a production wellbore by creating high pressure at an injection wellbore and low pressure at a production wellbore by injecting a slurry of sand and water into the injection wellbore.

Figure 4:
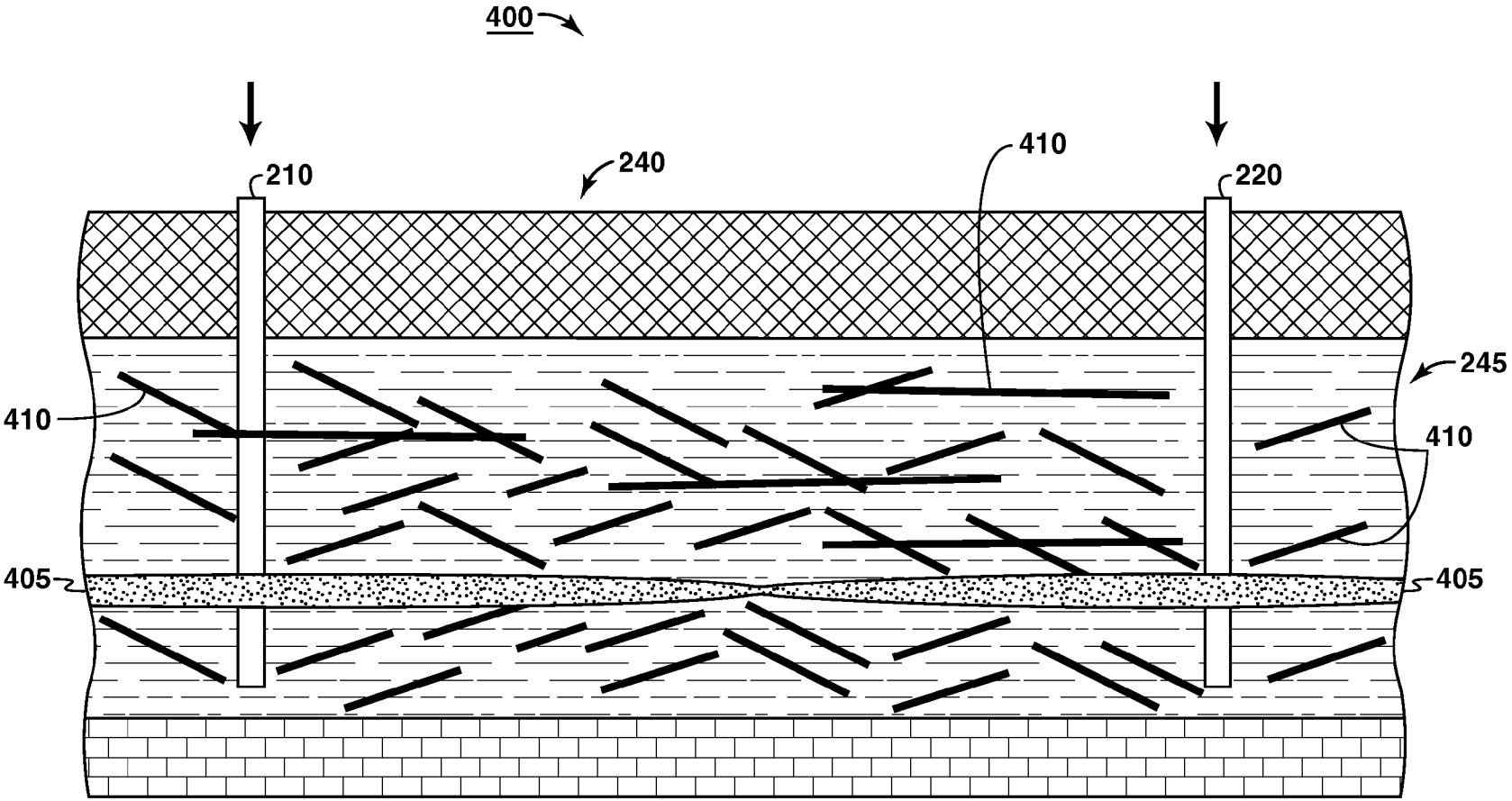
FIG. 4 is a schematic illustration to show the formation and injectant dynamics within a formation during the conditioning phase.

FIG. 4 is a schematic illustration of an alternative embodiment of the wellbore system 200 of FIG. 2, which may be used to implement the processes of FIGS. 1A-1B and generate a response like that illustrated in FIG. 3. As such, FIG. 4 may be best understood with reference to FIGS. 1A-1B, 2, and 3. FIG. 4 is an exemplary embodiment of a multi-wellbore system 400 utilizing a plurality of offset wellbores 210 and 220. Where injection fluid is passed through multiple wellbores (only two shown for simplicity) 210 and 220 for conditioning 104 the formation 240. The injection fluid can be injected into the hydrocarbon-bearing zone 245 through both the first wellbore 210 and the second wellbore 220 to substantially reduce the time required to at least slightly condition 304 the formation 240. For example, the time to relieve the stress of the overburden 230 may be reduced by as much as half or more.

Furthermore, the injection fluid can be emitted either simultaneously or sequentially through both wellbores 210, 220 to create or cause fractures 410 to propagate from near each wellbore 210, 220 into the formation, thereby allowing the injected fluid greater access to the formation and increasing the porosity/permeability throughout a greater area and/or volume 405 within the hydrocarbon-bearing zone 245 more quickly. By introducing injection fluid from multiple locations within the same formation 240, the hydraulically-induced horizontal (or sub-horizontal) fractures 410 and/or natural flow conduits 405 can help improve formation access and contact a larger portion of the formation 240 with fluid than could be contacted from the drilled wellbore alone.

Figure 5:
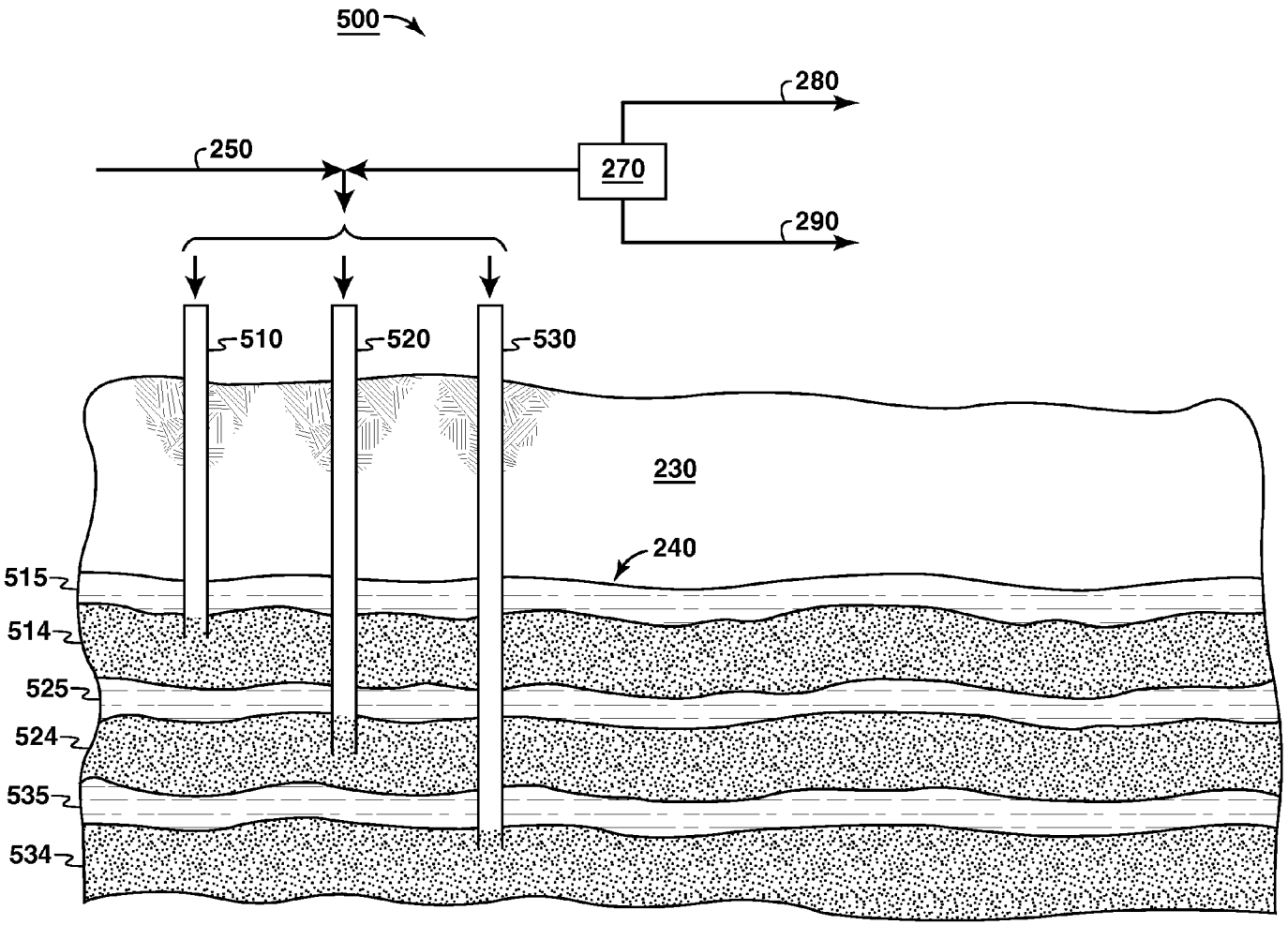
FIG. 5 is a schematic illustration of a multi-wellbore system for conditioning a subsurface formation according to certain embodiments of the invention.

FIG. 5 is a schematic illustration of an alternative embodiment of the wellbore system 200 of FIG. 2, which may be used to implement the processes of FIGS. 1A-1B and generate a response like that illustrated in FIG. 3. As such, FIG. 5 may be best understood with reference to FIGS. 1A-1B, 2, and 3. FIG. 5 is an exemplary embodiment of a multi-wellbore system 500 utilizing a plurality of wellbores 510, 520, 530 at different depths in the formation 240. Depending on the formation, portions or zones containing hydrocarbons 514, 524, 534 may be separated by low porosity/low permeability rock layers 515, 525, 535 that make production between zones difficult. In such a situation, it may be beneficial to inject or produce from multiple wellbores 510, 520, 530 at different depths or utilize a single wellbore 530 to inject fluids at a plurality of depths (one or more injections in each zone 514, 524, 534). Note that the illustration of three wellbores 510, 520, 530 and three zones 514, 524, 534 is merely exemplary and not a limiting embodiment. The number of wellbores 510, 520, 530 used will depend on the number of zones 514, 524, 534, cost, equipment, zone conditions, and other factors.

Still referring to FIG. 5, each of the three hydrocarbon-bearing zones 514, 524, and 534 can be conditioned and produced simultaneously or at least have some operations coexist at the same time. Alternatively, any one or more of the hydrocarbon-bearing zones 514, 524, and 534 can be conditioned and/or produced independently. For example, the first zone 514 can be conditioned and produced followed by the second zone 524 followed by the third zone 534.

In one or more embodiments, the hydrocarbon-bearing zones 514, 524, and 534 can be conditioned and/or produced sequentially. In yet another embodiment, any one of the wellbores 510, 520, 530 can be moved to a higher depth or lower depth to condition and/or produce any one of the hydrocarbon-bearing zones 514, 524, and 534, whether simultaneously, independently, or sequentially. The conditioning and production of a hydrocarbon-bearing zone has been shown and described above with reference to FIGS. 1A-1B, 2, 3, and 4 and for sake of brevity, will not be repeated here. Furthermore, any one or more of water jetting, high rate injection, pressure pulsing, and ramping up the fluid pressure techniques can equally be employed in the multi-wellbore system 500. These techniques are generally known to one skilled in the art.

Injection at multiple depths within the formation reduces the distance the injected fluid has to flow to slightly 304 or partially condition 306 the reservoir 240. In areas where hydraulically induced fractures may propagate in directions such that they do not contact a sufficient volume of the hydrocarbon-bearing zone, man-made or natural conduits to fluid flow may aid in accelerating the dispersement of injected fluid and pressure throughout the hydrocarbon-bearing zone. These man-made conduits may include, for example, wells, channels, or natural zones of higher absolute permeability or higher water saturation (and therefore higher permeability to the injected water).

In any of the embodiments above or elsewhere herein, the rate at which the injection fluid is injected into the hydrocarbon-bearing zone 245 is dependent on the size, thickness, permeability, porosity, number and spacing of wells, and depth of the zone 245 to be conditioned. For example, the injection fluid can be injected into the hydrocarbon-bearing zone 245 at a rate of from about 50 barrels per day per well to about 5,000 barrels per day per well.

In any of the embodiments above or elsewhere herein, the injection fluid can be injected at different depths within the formation 240 to access the hydrocarbon-bearing zone 245 therein. As mentioned above, the formation 240 can include embedded shale or mudstone layers that create baffles that prevent flow or that surround or isolate one or more hydrocarbon-bearing zones 245 within the formation 240. The injection fluid can be used to create multiple fractures at different depths, i.e. both above and below the shale or mudstone layers to access those one or more hydrocarbon-bearing zones 245 within the formation 240. The injection fluid can also be used to create multiple fractures at different depths to increase the permeability throughout the formation 240 so the overburden 230 can be supported and overburden stress relieved more quickly.

In any of the embodiments above or elsewhere herein, the injection fluid can be injected at different depths within the same wellbore using a perforated lining or casing where certain perforations are blocked or closed at a first depth to prevent flow therethrough, allowing the injection fluid to flow through other perforations at a second depth. In another embodiment, the injection fluid can be injected through a perforated lining or casing into the zone 245 at a first depth of a vertical wellbore or first location of a horizontal wellbore, and the perforated lining or casing can then be lowered or raised to a second depth or second location where the injection fluid can be injected into the zone 245. In yet another embodiment, a tubular or work string (not shown) can be used to emit the injection fluid at variable depths by raising and lowering the tubular or work string at the surface. In yet another embodiment, two or more injection wellbores 510, 520, 530 at different heights could be used to create fractures in the formation 240. In general, this would remove the problem of trying to create multiple fractures from a single wellbore.

Considering the injection fluid in more detail, the injection fluid is preferably primarily water or brine during the conditioning phase. In any of the embodiments above or elsewhere herein, the injection fluid can include water and/or one or more agents that may aid in the conditioning of the formation. Suitable agents may include but are not limited to those which increase the viscosity of the injected water.

In any of the embodiments above or elsewhere herein, the injection fluid can include air or other non-condensable gas, such as nitrogen, for example. The ex-solution of the gas from the water can help dilate and fluidize at least a portion of the hydrocarbon-bearing zones 245 within the formation 240 as the solids are displaced. In addition, the gas can help reduce the pressure drop required to lift the solids to the surface by decreasing the solids concentration and overall density of the slurry stream in the wellbore.

Initial Production

Once the conditioning process 104 is complete and the formation 240 has been at least slightly 302 or partially 304 conditioned, an initial production process (e.g. slurry production) 106 may be commenced. Initial production 106 primarily produces injection fluids and particulate solids such as sand, but may also produce at least some heavy oil and other fluids from the formation 240. Initial production 106 increases formation access and leaves behind high permeability channels or wormholes in the formation 240. Initial production 106 may comprise any number of processes, but primarily involves pulling up fluids and solids through the at least one formation access point 210.

The present invention provides methods and systems for increasing the productivity and ultimate recovery of heavy oil and sand by changing the mechanical properties of the reservoir and decreasing the mean effective stress 322 prior to initial production 106. These changes should allow multiple discrete wormholes to be created in the reservoir during cold flow production rather than just a single wormhole as is generally observed. The multiple wormholes should significantly enhance reservoir access for subsequent production processes.

Hydrocarbon Production

Hydrocarbon production 110 follows initial production 106 and comprises multiple embodiments. In one embodiment of the present invention, hydrocarbon production 110 comprises a single production process, which may be any number of processes, known or as yet unknown, but which may include at least, for example a cold heavy oil production with sand ("CHOPS") process. The CHOPS process is a conventional method of producing heavy oil from a formation. However, conventional CHOPS produces only about 5-10% of the heavy oil from a formation, is unavailable in certain formations and produces relatively few wormholes. Hydrocarbon production 110 may also include enhanced oil recovery processes such as thermal and solvent-based methods of producing heavy oils such as, for example, SAGD, ES-SAGD, SAVEX, or VAPEX.

In one alternative embodiment of the present invention, hydrocarbon production 110 includes developing a sequence of recovery techniques 152, then producing hydrocarbons using the sequence 154. The sequence may include standard production techniques such as CHOPS or enhanced production techniques such as SAGD, VAPEX, or other processes.

Figure 6A:
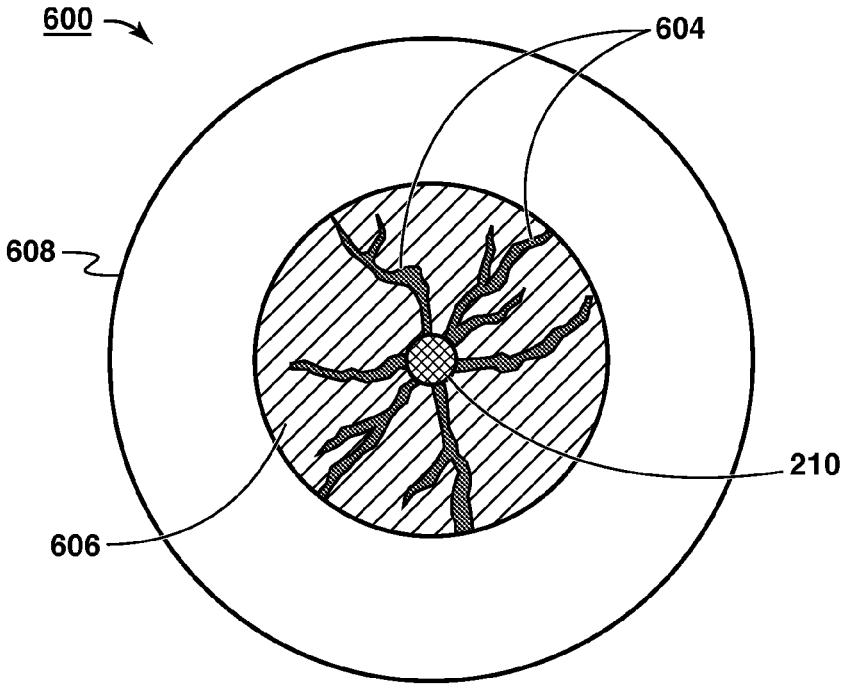
FIGS. 6A-6B are a map or plan view and a side view of a schematic illustration of the wellbore of FIG. 2 having wormholes extending away from it.
Figure 6B:
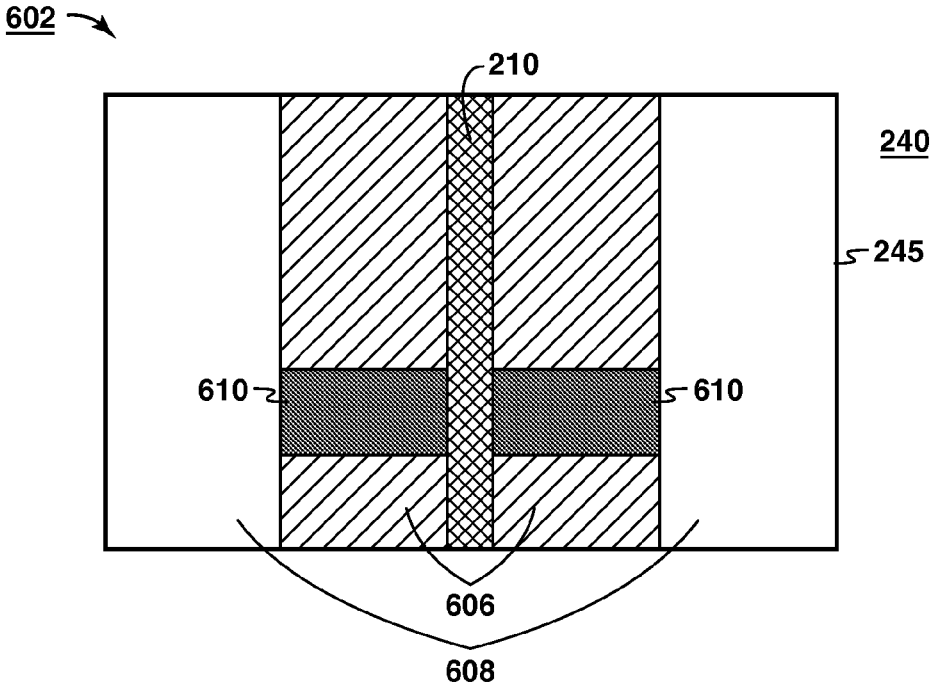

FIGS. 6A-6B are a map view 600 and cross-sectional view 602 of exemplary illustrations of a wellbore system like the one shown in FIG. 2 showing wormholes, which may be generated by one of the processes of FIGS. 1A-1B. Hence, FIGS. 6A-6B may be best understood with reference to FIGS. 1A-1B and 2. The map view 600 illustrates an exemplary wellbore system 200 after initial production 106 has generated wormholes 604 in the drainage region 606. The drainage region 606 is typically comprised of oil, water, foamy oil (gas bubbles in the oil) and wormholes 604. Beyond the drainage region 606, the formation 240 is unaffected and primarily contains oil and water. The cross-sectional view 602 illustrates an exemplary relative thickness of the pay zone 610. It should also be noted that the drainage region 606 generally extends through the hydrocarbon-bearing zone 245 of the formation 240.

In a typical CHOPS process the drainage region 606 is modest and might range from about 50 feet in diameter to about 200 feet in diameter, but in only one or two directions. Utilizing the present invention, the initial production (e.g. slurry production) process 106 may generate a drainage region from up to about 100 feet in diameter to well over at least 300 feet in diameter or even over about 500 feet in diameter. The present invention also beneficially produces a more substantial pay zone 610 and larger number of wormholes 604 to more fully drain the area around the wellbore. These increases result in greater exposed surface area within the hydrocarbon-bearing zone 245 to produce hydrocarbons utilizing enhanced production techniques 112.

The presence of a high pressure mobile water phase in the pore space (e.g. increased fluid pressure or pore pressure 320) after slight 304 or partial conditioning 306 may allow water production to drive the initial creation of wormholes 604. Once sufficient water was produced to lower the reservoir pressure and water saturation sufficiently to allow for oil production, the reservoir drive energy of the gas stored in solution in the oil is still available to drive the oil into the wormholes 604 and be produced. In standard CHOPS recovery, a significant portion of the reservoir drive energy goes into the early sand production/wormhole creation part of the process leaving less energy to produce the oil. Ultimate recovery from CHOPS is generally less than 10% of the oil in place in the reservoir interval being exploited. Conditioning the reservoir 104 prior to initial production 106 should increase the recovery efficiency by a factor of about 2 to up to about 5.

Beneficially, the present invention may increase the reservoir energy and the ability to flow sand in reservoirs where CHOPS would normally not work. Published field examples of the CHOPS process suggest that it does not work well if the viscosity of the oil is much above 10,000 to 14,000 cP and does not work well if there is not sufficient gas in solution to provide the reservoir energy both to push oil into the wormholes 604 and generate the wormholes 604 in the first place. The reservoir conditioning 104 process of the present invention increases the amount of fluid pressure and compaction energy stored in the reservoir 240 and this energy is available to drive out heavy oil and sand into the wellbore 210 or wellbores 210, 220. As such, production of more viscous oils than is generally possible would be made possible as well as production from reservoirs which have lower gas-oil ratios (GOR)-a measure of how much gas is stored in solution in the oil.

Another significant advantage of the present invention is the capability to increase the access to the reservoir 240 (for production of hydrocarbons and/or injection of steam and/or solvent to aid hydrocarbon production) without the need for horizontal wells by creating a large number of controlled wormholes 604 (as compared with CHOPS) that would act like uncased, open hole horizontal wells at a fraction of the cost of drilling a horizontal well. Depending on the reservoir depth and reservoir properties, a certain amount of reservoir conditioning 104 should allow the controlled creation of a group or groups of wormholes 604 as described above. Like the CHOPS process in a mostly conditioned 308 or partially conditioned 306 reservoir, these wormholes 604 could be created from production into a wellbore 210 (or wellbores 210, 220) or they could be created by paired injection and production from two adjacent wells which would create a wormhole 604 or wormhole 604 network between multiple wells 210, 220. The reservoir conditioning 104 would create a stress and rock mechanical property state such that these wormholes 604 are more likely to form and more easily formed than they would be in a non-conditioned 302 reservoir. In addition, creating reservoir access through the conditioning process 104 results in maintenance of the reservoir's drive energy even after the creation of the conditioning enhanced high permeability channels 604 (wormholes). In addition, different levels of conditioning 104 and use of sets of wells to produce the wormholes 604 could be used to control the number, orientation, and pattern of wormholes 604 produced.

In any of the embodiments above or elsewhere herein, a water jetting technique can be used to emit the injection fluid into the formation 240 to break up the sand or shale near the wellbore and to aid slurry flow into the wellbore. Preferably, the water jetting is a short, transitional step and used intermittently or for short periods of time. The water jetting technique can be performed through the first wellbore 210 or the second wellbore 220 or both. In one or more embodiments, the water jetting is done through the first wellbore 210 after the formation 240 is conditioned 104 to fluidize the sand and clay and create a slurry proximal to the wellbore 210 opening allowing the slurry to be produced through the wellbore 210. In addition, water jetting through the wellbore 210 can remove any hard rock fragments that are too big to flow up the wellbore 210 with the slurry. An illustrative water jetting technique is shown and described in U.S. Pat. No. 5,249,844. In addition to fluidizing a portion of the hydrocarbon-bearing zone 245 proximal to the wellbore 210, water jetting may be used to further break-up or disaggregate shale or mudstone layers proximal to the wellbore 210 to prevent them from impeding the flow of slurry toward the wellbore 210. During the initial production processes 106 the movement or displacement of some of the formation 240 towards the well 210 may allow the build-up of shale or mudstone near the wellbore 210 such that the flow of slurry into the wellbore 210 is impeded or the pressure gradient needed to move portions of the formation 240 increases beyond the pressure gradient that can be maintained. In such cases, additional water jetting in the production wellbore could be used to further break-up or disaggregate those shales or mudstones proximal to the production well and allow for them to be produced thereby allowing for unimpeded slurry flow into the wellbore 210.

It may also be advantageous to use one or more injection techniques to locally (either spatially or temporally) improve the conditioning process 104. The term "pulse" or "pulsing" refers to variations or fluctuations in injection or production rate or pressure.

Multi-Wellbore Systems and Wormhole Networks

The direction and magnitude of heterogeneities (e.g. cemented sand, mudstone layers, shale layers, etc.) in reservoir and rock properties is most often unknown and as such the control of wormhole direction and number of wormholes is difficult. However, simulations show that the larger the increase in reservoir fluid pressure (e.g. the further along the conditioning from "slight" to "full"), the more extensive the wormhole formation is likely to be. It is also possible through partial conditioning to control the direction and number of wormholes by utilizing multiple wellbores and creating wormholes between various wellbores. When wormholes extend from one wellbore to another wellbore or to another wormhole extending from another wellbore, this is called a "networking effect."

In one exemplary embodiment of a multi-wellbore approach, the reservoir is at least slightly conditioned, then production from a particular wellbore or sub-set of wellbores can be initiated while injection continues in another sub-set of wellbores, which may be all of the remaining wellbores or only a portion of the remaining wellbores. The pressure difference between the first wellbore or set of wellbores and the second wellbore or set of wellbores is likely to produce at least one wormhole between the first and second sets of wellbores. This is because the sand production leading to wormhole formation is directly related to the pressure gradient in the reservoir. The pressure gradient in the reservoir may be directly or indirectly affected by pushing (e.g. injection) or pulling (e.g. production) forces from the various wellbores. Sequencing which wells are injecting and which wells are producing may generate networks of wormholes between the various wells. Such networks should be able to be formed in a controlled fashion by controlling the pressure gradient after making determinations regarding the reservoirs properties, including the heterogeneities, mean stress, critical state line slope, and others. One exemplary arrangement of wellbores is a "five spot pattern," a description of which may be found in Int'l Pat. App. WO2007/050180, the portions of which dealing with five spot patterns are hereby incorporated by reference. Unlike the method disclosed in the '180 application, the present methods and systems may utilize each well as both an injection/conditioning well and a production well, as shown in FIG. 2.

Model Results

Figure 7A:
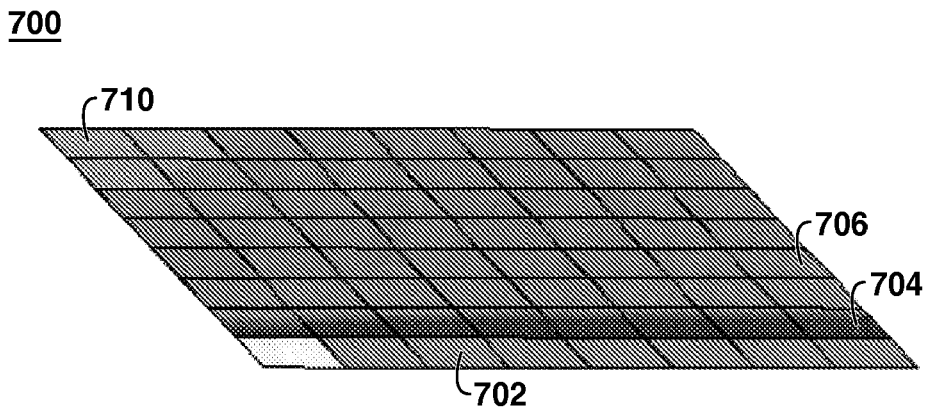
FIGS. 7A-7C show a graphic illustration of results of wellbore modeling at increasing levels of conditioning.
Figure 7B:
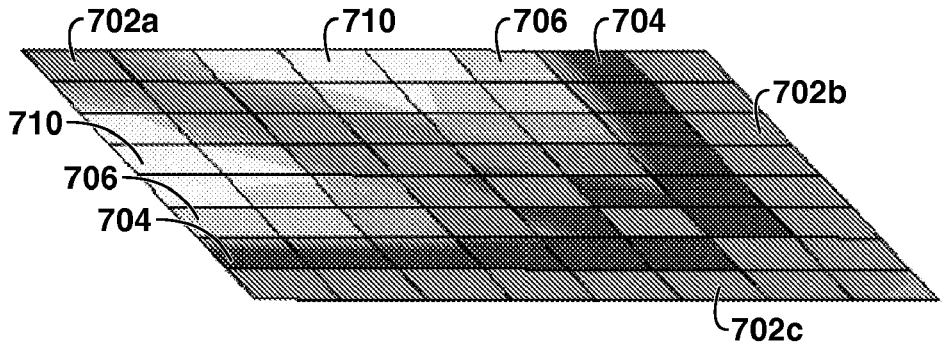
Figure 7C:
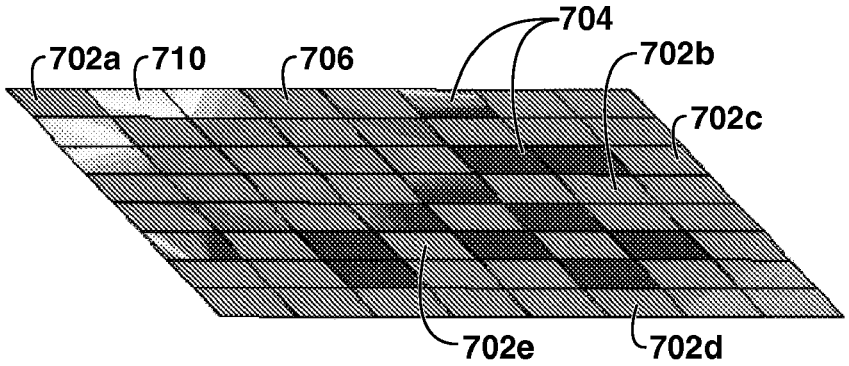

FIGS. 7A, 7B, and 7C show exemplary numerical simulations of the potential impact of increasing amounts of reservoir conditioning 104 on the distribution of wormholes 604 formed from an initial production process 106 using a wellbore system 200. As such, FIGS. 7A-7C are best understood with reference to FIGS. 1, 2, and 6A-6B. FIG. 7A illustrates the plan view 700 of an unconditioned 302 reservoir interval where sand production is allowed to be initiated in a slightly weaker zone of the formation 240. The simulation was run at a depth of 450 meters, 3.2 MegaPascals (MPa) effective (mean) stress, and 2.0 MPa drawdown. After a period of initial production 106, a wormhole 702 formed but it is surrounded by more highly stressed sand 704, 706 than the rest of the reservoir interval 710 (included in the formation 240). In general, the weight of the overburden 230 on the formation sand creates enough friction to prevent the sand from flowing into the wellbore 210 with the oil. However, the very viscous nature of heavy oil (1,000 to 100,000 centipoise or cP), and the weak nature of the sand often allows some sand production to occur during initial production 106. The simulation results illustrated in FIGS. 7A-7C show one likely mechanism for this sand production, which is a slightly weaker zone in the layer or reservoir which allows some sand to be produced. The overburden weight (e.g. mean effective stress 322) then "arches" near the wormhole 702 which plays the dual role of preventing further sand production to the sides of the wormhole (due to higher stress holding the sand in place) and allowing the growth of the wormhole away from the wellbore where the stresses are lower than normal due to the "arch" effect.

FIGS. 7B and 7C show the simulated effect of increasing the degree of conditioning and therefore reducing the stress on the sand and enhancing wormhole production. FIG. 7B is a simulation having a mean stress of 1.0 megapascals (MPa), which represents an exemplary amount of mean stress in a partially conditioned 306 reservoir. As shown, the number of wormholes 702*a*-702*c* and lower stress areas 710 have increased, while the high stress areas 704, 706 have decreased. Note that small heterogeneities in the mechanical properties of the formation 240 allowed three distinct wormholes 702*a*-702*c* to form during production in this numerical simulation of a partially conditioned reservoir. In FIG. 7C, the simulation has a mean effective stress 322 of 0.6 MPa, which represents an exemplary amount of mean effective stress 322 in a mostly conditioned 308 reservoir. As shown, the number of wormholes 702*a*-702*e* has significantly increased over the unconditioned reservoir model 302 and the partially conditioned model 306. Also, there are even fewer areas of high stress 704, 706.

While the present invention may be susceptible to various modifications and alternative forms, the exemplary embodiments discussed above have been shown only by way of example. However, it should again be understood that the invention is not intended to be limited to the particular embodiments disclosed herein. Indeed, the present invention includes all alternatives, modifications, and equivalents falling within the true spirit and scope of the appended claims.

What is claimed is:

1. A method for obtaining heavy oil by increasing access to a subsurface formation, comprising:

accessing from a location, a subsurface formation having an overburden stress disposed thereon, the subsurface formation comprising heavy oil and uncemented sands;

conditioning throughout the subsurface formation from the location by increasing fluid pressure throughout the subsurface formation to develop a relatively constant fluid pressure within the subsurface formation, wherein the conditioning relieves the overburden stress to allow at least a portion of the uncemented sands to become mobile;

initially producing from the location a portion of the uncemented sands made mobile by the conditioning and at least one fluid from the subsurface formation to increase access to the subsurface formation, wherein the step of initially producing utilizes the increased fluid pressure in the subsurface formation; and producing from the location at least a portion of the heavy oil from the subsurface formation utilizing the increased access.

2. The method of claim 1, wherein the increased access to the subsurface formation includes generating at least one high permeability channel in the subsurface formation.

3. The method of claim 2, wherein the conditioning is sufficient to increase the permeability of the formation.

4. The method of claim 3, wherein the conditioning is one of slightly conditioned, partially conditioned, and mostly conditioned.

5. The method of claim 3, wherein the conditioning comprises injecting a conditioning fluid through one or more of the location within a hydrocarbon-bearing zone of the subsurface formation.

6. The method of claim 5, wherein the conditioning fluid comprises one of an aqueous fluid and a hydrocarbon based fluid.

7. The method of claim 6, wherein injecting the conditioning fluid comprises injecting the conditioning fluid at more than one depth within the hydrocarbon-bearing zone.

8. The method of claim 7, wherein accessing the subsurface formation from the location comprises accessing the subsurface formation from at least one wellbore.

9. The method of claim 8, wherein injecting the conditioning fluid at more than one depth comprises one of injecting conditioning fluid at more than one depth in one wellbore, injecting conditioning fluid at one depth in one wellbore and a different depth in another wellbore, and injecting conditioning fluid at more than one depth in more than one wellbore.

10. The method of claim 8, wherein the at least one wellbore comprises four wellbores disposed about a centrally located fifth wellbore.

11. The method of claim 7, further comprising water jetting into the subsurface formation after conditioning the subsurface formation.

12. The method of claim 11, wherein conditioning the formation comprises any one of high rate injection, pressure pulsing, and ramping up the fluid pressure.

13. The method of claim 6, wherein the at least one fluid produced in the step of initially producing is selected from the group consisting of conditioning fluid, formation fluid, and any combination thereof.

14. The method of claim 6, wherein producing from the location at least a portion of the heavy oil comprises at least one of a cold heavy oil production process and at least one enhanced production process.

15. The method of claim 14, wherein the at least one enhanced oil recovery process comprises utilizing the at least one high permeability channel configured to increase access to the subsurface formation.

16. The method of claim 15, wherein the enhanced oil recovery process is any of steam flood and steam drive, cyclic steam stimulation, water injection, inert gas injection, hydrocarbon solvent injection, steam assisted gravity drainage, vapor-assisted extraction, gravity stabilized combustion, and any combination thereof.

17. The method of claim 1, further comprising developing a sequence of enhanced oil recovery processes designed to produce at least a portion of the heavy oil utilizing the increased access.

18. The method of claim 17 further comprising executing the sequence of enhanced oil recovery processes to recover at least a portion of the heavy oil.

19. The method of claim 1, wherein the subsurface formation initially comprises a property selected from the group comprising at least one consolidated layer, at least one heterogeneity, low initial gas content, high viscosity hydrocarbon fluids, low drive energy, and any combination thereof.

20. The method of claim 19, wherein the amount of conditioning is dependent upon factors consisting of: the viscosity of the hydrocarbon fluids, the initial gas content, the direction and magnitude of heterogeneities, the amount of fluid pressure increase, and any combination thereof.

21. A method for recovering heavy oil, comprising:

accessing from a location, a subsurface formation having an overburden stress disposed thereon, the subsurface formation comprising heavy oil and uncemented sands;

conditioning throughout the subsurface formation from the location using fluids to increase fluid pressure throughout the subsurface formation to develop a relatively constant fluid pressure within the subsurface formation, wherein the conditioning relieves the overburden stress to allow at least a portion of the uncemented sands to become mobile; and increasing access to the subsurface formation utilizing the increased fluid pressure in the subsurface formation by producing from the location a portion of the uncemented sands and fluids from the conditioned subsurface formation.

22. The method of claim 21, further comprising producing at least a portion of the heavy oil from the subsurface formation utilizing the increased access, wherein the producing at least a portion of the heavy oil from the subsurface formation comprises any of a cold heavy oil production process and at least one enhanced production process.

23. The method of claim 21, further comprising developing at least one sequence of at least two enhanced production processes designed to produce at least a portion of the heavy oil utilizing the increased access; and producing at least a portion of the heavy oil by performing at least two of the enhanced production processes according to the at least one sequence.

24. The method of claim 23, wherein the at least two enhanced production processes are any of: steam flood and steam drive, cyclic steam stimulation, water injection, hydrocarbon solvent injection, inert gas injection, steam assisted gravity drainage, vapor-assisted extraction, gravity stabilized combustion, and any combination thereof.

25. The method of claim 21, wherein the conditioning is one of slightly conditioned, partially conditioned, and mostly conditioned.

26. A method for obtaining bitumen by increasing access to an oil sand subsurface formation, comprising:

accessing from a location the oil sand subsurface formation having an overburden stress disposed thereon, the oil sand subsurface formation comprising bitumen and one or more solids;

conditioning the oil sand subsurface formation from the location by increasing fluid pressure in the oil sand subsurface formation, wherein the conditioning results in the mean effective stress of the subsurface formation decreasing while the differential stress increases;

initially producing from the location only a portion of the bitumen and one or more solids and at least one fluid from the oil sand subsurface formation to increase access to the oil sand subsurface formation, wherein the step of initially producing utilizes the increased fluid pressure in the oil sand subsurface formation; and producing from the location at least a portion of the bitumen and one or more solids from the oil sand subsurface formation utilizing the increased access.

* * * * *